US007316096B2

(12) United States Patent
Houser et al.

(10) Patent No.: US 7,316,096 B2
(45) Date of Patent: Jan. 8, 2008

(54) DOOR OPERATOR

(75) Inventors: Blue Houser, Edgemoor, SC (US); Sidney J. Lampley, Monroe, NC (US); Robert Tadlock, Charlotte, NC (US); Tom Harris, Charlotte, NC (US); John Presely, Monroe, NC (US); Jeff Schoener, Charlotte, NC (US); Lana Kirkpatrick, Monroe, NC (US)

(73) Assignee: Yale Security Inc., Monroe, NC (US)

( * ) Notice: Subject to any disclaimer, the term of this patent is extended or adjusted under 35 U.S.C. 154(b) by 387 days.

(21) Appl. No.: 10/710,285

(22) Filed: Jun. 30, 2004

(65) Prior Publication Data

US 2006/0010771 A1 Jan. 19, 2006

(51) Int. Cl.
*E05F 11/28* (2006.01)

(52) U.S. Cl. ..... 49/345; 49/139; 49/339; 49/340; 49/341

(58) Field of Classification Search ..... 49/139, 49/140, 339, 340, 341, 345
See application file for complete search history.

(56) References Cited

U.S. PATENT DOCUMENTS

| | | | |
|---|---|---|---|
| 618,053 | A | 1/1899 | Brown |
| 2,843,376 | A | 7/1958 | Osuch et al. |
| 2,924,449 | A | 2/1960 | Leimer et al. |
| 3,114,541 | A | 12/1963 | Coffey |
| 3,284,950 | A | 11/1966 | Gute |
| 3,886,425 | A | 5/1975 | Weiss |
| 4,045,914 | A | 9/1977 | Catlett |
| 4,220,051 | A | 9/1980 | Catlett |
| 4,330,958 | A | 5/1982 | Richmond |
| 4,333,270 | A | 6/1982 | Catlett |
| 4,348,835 | A | 9/1982 | Jones et al. |
| 4,429,490 | A | 2/1984 | Zunkel |
| 4,553,656 | A | 11/1985 | Lense |
| 4,658,545 | A | 4/1987 | Ingham et al. |
| 4,660,324 | A | 4/1987 | Nyenbrink |

(Continued)

FOREIGN PATENT DOCUMENTS

| | | |
|---|---|---|
| JP | 6033994 | 2/1994 |

*Primary Examiner*—Jerry Redman
(74) *Attorney, Agent, or Firm*—Moore & Van Allen PLLC; Michael G. Johnston

(57) ABSTRACT

A drive mechanism is provided for a door operator, comprising a drive member and a driven member. The drive member includes a protrusion, the edges of the protrusion forming first and second driving surfaces which define a free space of at least about 90° there between. The driven member includes a protrusion, the sides of the protrusion form a first and a second driven surface, respectively. The drive member is adapted to be operably connected to between a motor assembly for rotating the drive member and a door closer assembly rotating with the driven member. The drive member and the driven member are disposed for relative rotation in substantially the same plane such that the driven member protrusion moves in the free space defined by the driving surfaces of the drive member protrusion. Rotation of the drive member from a first angular orientation to a second angular orientation in a direction toward an adjacent driven surface causes rotation of the driven member for powered opening of the door from the closed position to the open position. The driven member protrusion moves in the free space without engaging the protrusion surfaces when the door is opened manually from the closed position and allowed to close.

23 Claims, 9 Drawing Sheets

U.S. PATENT DOCUMENTS

| | | | |
|---|---|---|---|
| 4,669,218 | A | 6/1987 | Kombrekke et al. |
| 4,727,679 | A | 3/1988 | Kombrekke et al. |
| 4,966,266 | A | 10/1990 | Yamada et al. |
| 4,972,629 | A | 11/1990 | Merendino et al. |
| 5,018,304 | A | 5/1991 | Longoria |
| 5,024,124 | A | 6/1991 | Popov et al. |
| 5,040,331 | A | 8/1991 | Merendino et al. |
| 5,221,239 | A | 6/1993 | Catlett |
| 5,375,374 | A | 12/1994 | Rohraff, Sr. |
| 5,507,120 | A | 4/1996 | Current |
| 5,513,467 | A | 5/1996 | Current et al. |
| 5,634,296 | A | 6/1997 | Hebda |
| 5,752,344 | A | 5/1998 | Richmond |
| 5,878,530 | A | 3/1999 | Eccleston et al. |
| 5,881,497 | A | 3/1999 | Borgardt |
| 5,930,954 | A | 8/1999 | Hebda |
| 6,006,475 | A | 12/1999 | Schwantes et al. |
| 6,067,753 | A | 5/2000 | Hebda |
| 6,108,975 | A | 8/2000 | Bailey |
| 6,223,469 | B1 | 5/2001 | Moll |
| 6,318,196 | B1 | 11/2001 | Chang |
| 6,430,871 | B1 | 8/2002 | Hebda |
| 6,481,160 | B1 | 11/2002 | Kowalczyk |
| 6,553,717 | B2 | 4/2003 | St. John et al. |
| 6,588,153 | B1 | 7/2003 | Kowalczyk |
| 6,634,140 | B1 | 10/2003 | Sellman |

DOOR OPERATOR

BACKGROUND OF INVENTION

This invention relates generally to door operators, and more particularly to a door operator for selectively automatically or manually opening a door.

The purpose of door operators is to open and close a door. Automatic door operators are used on public buildings and residences to allow for access by the physically disabled or where manual operation of the door may be inconvenient to users. In public facilities, it is a required American National Standard that doors which provide ingress and egress have the ability to open automatically in order to allow handicapped people passage through the doorway.

A variety of electro-mechanical automatic door operators are known. A typical door operator includes an electric motor and a linkage assembly for operatively coupling the drive shaft of the motor to a door so that the door will be opened and closed when the drive shaft rotates. Activation of the door operator is initiated by means of an electric signal generated in a variety of ways such as, for example, a pressure switch, an ultrasonic or photoelectric presence sensor, motion sensors, radio transmitters, wall switches, and the like. The door may then be closed under power or with a door closer. A conventional door closer uses an internal spring mechanism which is compressed during the opening of the door for storing sufficient energy so that the door can be returned to a closed position without the input of additional electrical energy. In the some door operators, the automatic, powered opening system is still engaged so that the spring force of the door closer must overcome the resistance caused by counter-rotating the gear train coupled to the motor. Since this spring force must be large, an individual manually opening the door must exert substantial force to overcome the spring force and the resistance forces generated by the opening system. Moreover, driving the components of the powered opening system during manual opening and closing of the door causes the gear train to become worn more quickly over time.

Some door operator systems are provided with clutch mechanisms between the motor and the linkage assembly that enable the door to be moved freely under manual power. Various clutching mechanisms decouple powered opening system during the closing cycle, which is particularly necessary in the event of an interruption of power supply. This solution still presents problems. For example, a door operator utilizing a slip clutch or the like will create some drag or resistance when the door is manually opened or closed. Moreover, conventional clutch mechanisms which do not create resistance suffer from a limited range of motion.

For the foregoing reasons, there is a need for a door operator which allows for selective automatic or manual door operation wherein manual opening and closing of the door does not engage any of the components within an automatic powered door opener, allowing the user to pass through the door as though the door were not equipped with the door operator. The new door operator should function with various combinations of door configurations, including push and pull side applications and right-hand and left-hand doors. Ideally, the new door operator would be adapted for use with existing door construction.

SUMMARY OF INVENTION

According to the present invention, a drive mechanism is provided for a door operator for selectively automatically operating a door positioned within a door frame and hinged along one edge to the door frame for movement between a closed position and an open position. The drive mechanism comprises a drive member and a driven member. The drive member includes a protrusion extending from the surface of the drive member. The edges of the protrusion form first and second driving surfaces, respectively, which define a free space of at least about 90° there between. The drive member is adapted to be operably connected to a motor assembly for rotating the drive member about an axis through an arc in a first direction from a first angular orientation corresponding to the closed position of the door to a second angular orientation corresponding to the open position of the door, and about the axis through an arc in an opposite direction from the second angular orientation to the first angular orientation. Rotation of the drive member from the first angular orientation to the second angular orientation corresponds to movement of the door from the closed position to the open position. The driven member includes a protrusion extending from the surface of the driven member. The sides of the protrusion form a first and a second driven surface, respectively. The driven member is adapted to be connected for rotation with a door closer assembly about an axis through an arc between a first angular orientation corresponding to the closed position of the door and a second angular orientation corresponding to the open position of the door, and about the axis through an arc in an opposite direction from the second angular orientation to the first angular orientation. Rotation of the driven member from the second angular orientation to the first angular orientation corresponds to movement of the door from an open position to the closed position. The drive member and the driven member are disposed for relative rotation in substantially the same plane such that the driven member protrusion moves in the free space defined by the driving surfaces of the drive member protrusion. When the drive member and the driven member are in their respective first angular orientations, one of the driving surfaces of the protrusion of the drive member is adjacent one of the driven surfaces of the protrusion of the driven member such that rotation of the drive member from the first angular orientation to the second angular orientation in a direction toward the adjacent driven surface causes rotation of the driven member for powered opening of the door from the closed position to the open position. The driven member protrusion moves in the free space from the first angular orientation to the second angular orientation without engaging the protrusion surfaces when the door is opened manually from the closed position and allowed to close.

Also according to the present invention, an apparatus is provided for use with a source of electrical energy for selectively automatically operating a door positioned within a door frame and hinged along one edge to the door frame for movement between a closed position and an open position. The door operating apparatus comprises a bi-directional motor assembly adapted to be coupled to the source of electrical energy. An automatic door closer assembly, adapted to be operably connected to the door, includes a rotatable output shaft and means for providing a force on the shaft when the door is in an open position for moving the door in the closing direction. A drive member includes a protrusion extending from the drive member. The edges of the protrusion form first and second driving surfaces, respectively, which define a free space of at least about 90° there between. The drive member is operably connected to the motor assembly for rotating the drive member about an axis through an arc in a first direction from a first angular orientation corresponding to the closed position of the door to a second angular orientation corresponding to the open position of the door, and about the axis through an arc in an opposite direction from the second angular orientation to the first angular orientation. Rotation of the drive member from the first angular orientation to the second angular orientation corresponds to movement of the door from the closed position to the open position. A driven member includes a protrusion extending from the surface of the driven member. The sides of the protrusion form a first and a second driven surface, respectively. The driven member is connected for rotation to the door closer assembly about an axis through an arc between a first angular orientation corresponding to the closed position of the door and a second angular orientation corresponding to the open position of the door, and about the axis through an arc in an opposite direction from the second angular orientation to the first angular orientation. Rotation of the driven member from the second angular orientation to the first angular orientation corresponds to movement of the door from an open position to the closed position. The drive member and the driven member are disposed for relative rotation in substantially the same plane such that the driven member protrusion moves in the free space defined by the driving surfaces of the drive member protrusion. When the drive member and the driven member are in their respective first angular orientations, one of the driving surfaces of the protrusion of the drive member is adjacent to one of the driven surfaces of the protrusion of the driven member such that rotation of the drive member from the first angular orientation to the second angular orientation in a direction toward the adjacent driven surface causes rotation of the driven member for powered opening of the door from the closed position to the open position. The driven member protrusion moves in the free space from the first angular orientation to the second angular orientation without engaging the protrusion surfaces when the door is opened manually from the closed position and allowed to close.

Further according to the present invention, a method is provided for using a door operator for selectively automatically operating a door positioned within a door frame and hinged along one edge to the door frame for movement between a closed position and an open position. The door operating method comprises the steps of providing a drive mechanism adapted to be disposed between a motor assembly and a door closer assembly. The drive mechanism comprises a drive member and a driven member. The drive member includes a protrusion extending from the surface of the drive member. The edges of the protrusion form first and second driving surfaces, respectively. The drive member is adapted to be operably connected to the motor assembly for rotating the drive member about an axis through an arc in a first direction from a first angular orientation corresponding to the closed position of the door to a second angular orientation corresponding to the open position of the door, and about the axis through an arc in an opposite direction from the second angular orientation to the first angular orientation. Rotation of the drive member from the first angular orientation to the second angular orientation corresponds to movement of the door from the closed position to the open position. The driven member includes a protrusion extending from the surface of the driven member. The sides of the protrusion form a first and a second driven surface, respectively. The driven member is adapted to be connected for rotation to the door closer assembly about an axis through an arc between a first angular orientation corresponding to the closed position of the door and a second angular orientation corresponding to the open position of the door, and about the axis through an arc in an opposite direction from the second angular orientation to the first angular orientation. Rotation of the driven member from the second angular orientation to the first angular orientation corresponds to movement of the door from an open position to the closed position. The drive member and the driven member are disposed for relative rotation in substantially the same plane such that the driven member protrusion moves in the free space defined by the driving surfaces of the drive member protrusion. When the drive member and the driven member are in their respective first angular orientations, one of the driving surfaces of the protrusion of the drive member is adjacent to one of the driven surfaces of the protrusion of the driven member. The method of the present invention further comprises the steps of rotating the drive member in a direction toward the adjacent driven surface from the first angular orientation toward the second angular orientation causing rotation of the driven member for powered opening of the door from the closed position to an open position, and rotating the drive member in an opposite direction toward the first angular orientation of the driving member at a speed faster than the door closer assembly rotates the driven member toward the first angular orientation of the driven member such that the driven member protrusion moves in the free space without engaging the driving surfaces when the door is allowed to close.

BRIEF DESCRIPTION OF DRAWINGS

For a more complete understanding of the present invention, reference should now be had to the embodiments shown in the accompanying drawings and described below. In the drawings.

DETAILED DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGS. Indeed, the referenced components may be oriented in any direction and the terminology, therefore, should be understood as encompassing such variations unless specified otherwise.

As used herein, the term "open position" for a door means a door position other than a closed position, including any position between the closed position and a fully open position as limited only by structure around the door frame, which can be up to 180° from the closed position.

Figure 1:
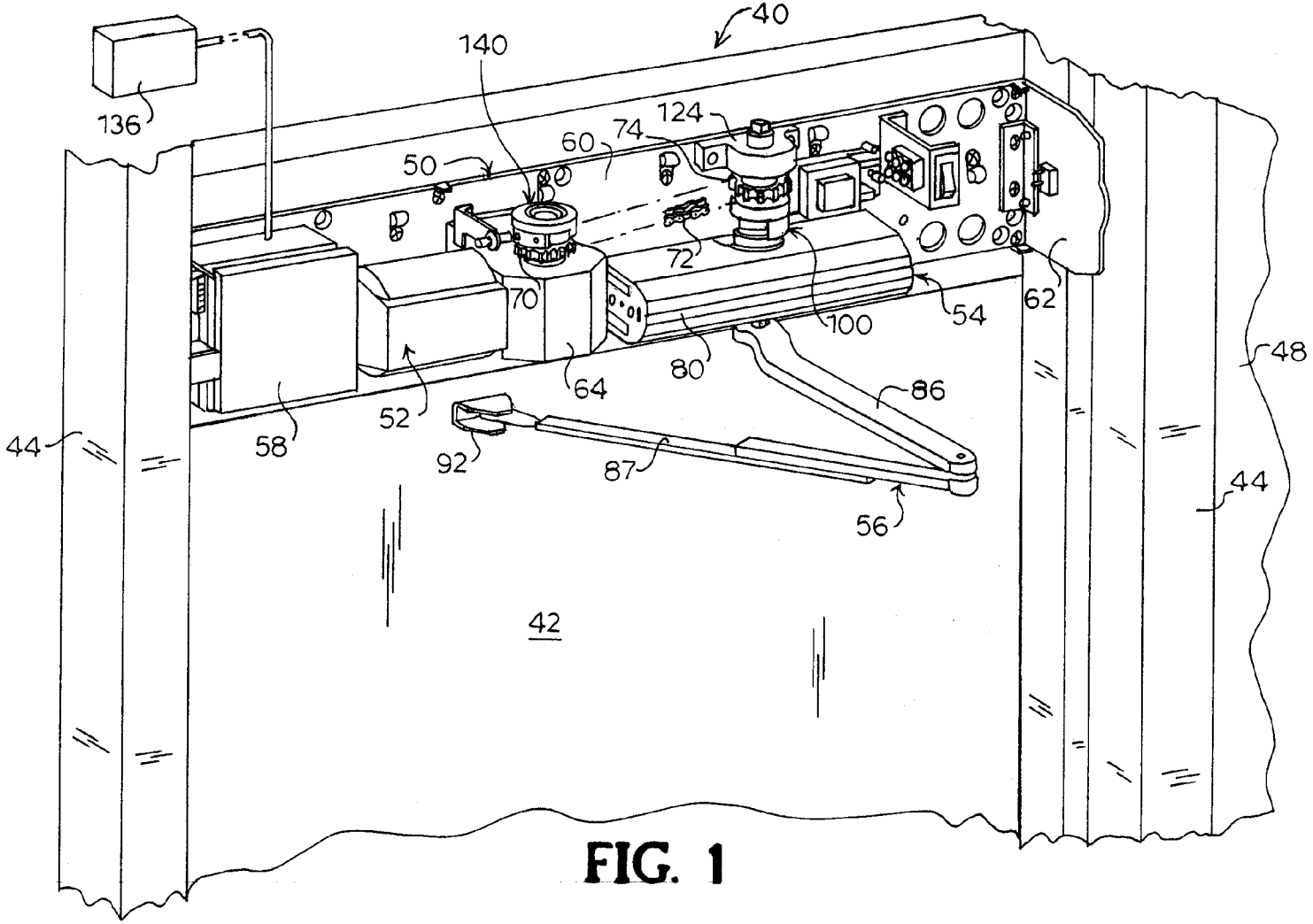
FIG. 1 is cut-away perspective view of a door operator according to the present invention in position on a door with a push side linkage assembly.

Referring now to the drawings, wherein like reference numerals designate corresponding or similar elements throughout the several views, a door operator according to the present invention is shown in FIG. 1 and generally designated at 40. The door operator 40 is mounted adjacent to a door 42 in a door frame 44 for movement of the door 42 relative to the frame 44 between a closed position and an open position. For the purpose of this description, only the upper portion of the door 42 and the door frame 44 are shown. The door 42 is of a conventional type and is pivotally mounted to the frame 44 for movement from the closed position, as shown in FIG. 1, to an open position for opening and closing an opening through a building wall 48 to allow a user to travel from one side of the wall 48 to the other side of the wall 48.

Figure 2:
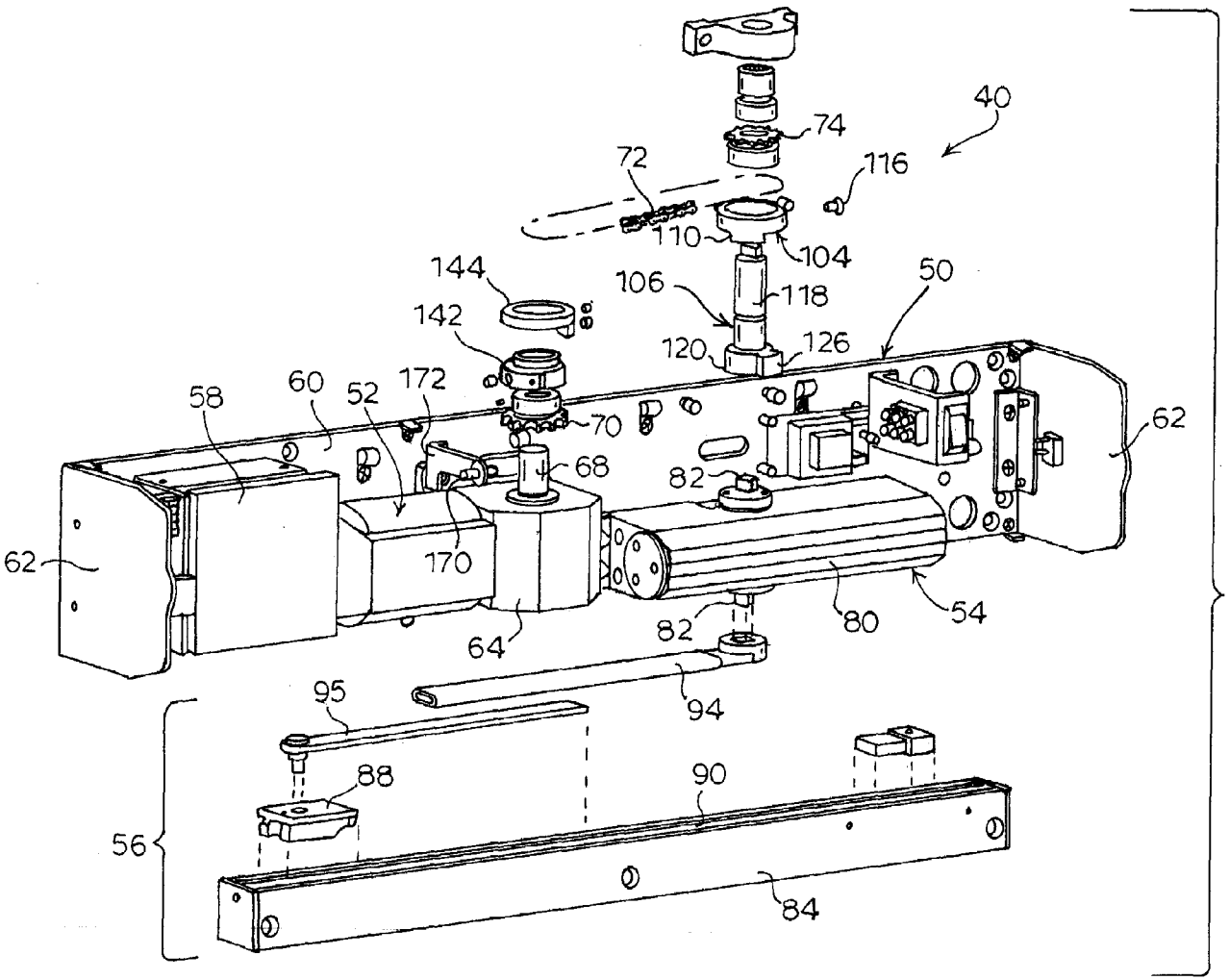
FIG. 2 is an exploded view of the door operator shown in FIG. 1 with a pull side linkage assembly.

Referring to FIGS. 1 and 2, the door operator 40 according to the present invention comprises a back plate 50, a motor assembly 52, a door closer assembly 54 including a linkage assembly 56 for operably coupling the door operator 40 to the door 42, and a controller 58. The back plate 50 has substantially flat rear wall 60 and end walls 62. The back plate 50 is securely mounted to the upper edge of the door frame 44 using mounting bolts (not shown), or other fasteners. The back plate 50 extends generally horizontally with respect to the door frame 44. The motor assembly 52, door closer assembly 54, and controller 58 are fixed to the back plate 50. A cover (not shown) attaches to the back plate 50. The cover serves to surround and enclose the components of the door operator 40 to reduce dirt and dust contamination, and to provide a more aesthetically pleasing appearance. It is understood that although the back plate 50 is shown mounted directly to the door frame 44, the back plate 50 could be mounted to the wall 48 adjacent the door frame 44 or concealed within the wall 48 or door frame 44. Concealed door operators are well known in the art of automatic door operators.

The motor assembly 52 includes an electric motor 64 and a drive train. The motor 64 is a conventional 3 phase AC electric reversible motor with a motor drive shaft 68. A portion of the drive shaft 68 extends vertically from the housing of the motor 64. The motor 64 is reversible such that the rotation of the motor 64 in one direction will cause the drive shaft 68 to rotate in one direction and rotation of the motor 64 in the opposite direction will cause the drive shaft 68 to rotate in the opposite direction. Such motors are widely commercially available and the construction and operation of such motors are well known; therefore, the details of the motor 64 are not described in specific detail herein. A suitable motor 64 for use in the door operator 40 of the present invention is available from Brother of Somerset, N.J., as model no. BHLM15L-240TC2N, which is a 240 volt motor providing 1/50 HP and a gear ratio of 240:1.

In one embodiment of the invention, the drive train comprises a drive gear 70, a roller chain 72, and a driven gear 74. The drive gear 70 and driven gear 74 comprise sprockets. The drive gear 70 is mounted for rotation with the motor drive shaft 68. The roller chain 72 is keyed with the drive gear 70 and driven gear 74 so that when the drive shaft 68 and drive gear 70 are rotated, the driven gear 74 is likewise rotated, as will be described further below.

The door closer assembly 54 is provided for returning the door 42 to the closed position when the door 42 has been opened either under power or manually. In addition to the linkage assembly 56, the door closer assembly 54 includes a door closer 80 of standard construction which provides a closing force on the door 42 when the door is in an open position. The door closer 80 includes a rotating operator shaft 82, a portion of which extends from both sides of the housing of the door closer 80 for driving the linkage assembly 56 to control the position of the door 42. Such door closers are well known in the art and do not require further description herein. A suitable door closer 80 for use in the door operator 40 of the present invention is a Norton 1601 surface mounted door closer available from Norton Door Controls of Monroe, N.C.

FIG. 1 shows a linkage assembly 56 for a push side mounting of the door operator 40 to the door 42, comprising a first rigid connecting arm link 86 and a second rigid connecting arm link 87. The first connecting arm link 86 is fixed at one end for rotation with the lower end of the door closer shaft 82 and at the other end is pivotally connected to an end of the second connecting arm link 87. The other end of the second connecting arm link is pivotally joined to a mounting bracket 92 fixed to the door 42.

FIG. 2 shows a linkage assembly 56 for a pull side mounting of the door operator 40 to the door 42. The pull side mounting linkage assembly 56 comprises a first rigid connecting arm link 94, a second rigid connecting arm link 95, and an elongated slide track housing 84 which is adapted to be mounted generally horizontally along the top of the door 42. One end of the first connecting arm link 94 is fixed for rotation with the lower end of the shaft 82 of the door closer 80, which has been rotated 180° relative to its position in FIG. 1. The other end of the first connecting arm link 94 slidably receives one end of the second connecting arm link 95. The other end of the second connecting arm link 95 is pivotally connected to a slider 88. The slider 88 is disposed in an upwardly opening slot 90 provided in the slide track housing 84 and is capable of moving linearly back and forth within the interior of the slide track housing 84 during opening and closing of the door 42. Rotation of the first connecting arm link 94 as the door 42 is moved in the opening direction will cause the slider 88 to slide rectilinearly within the slide track housing 84 toward the hinged side of the door 42. It is understood that the rotation of the motor drive shaft 68 for powered opening of the door 42 will be opposite to that of the push side application described above. Reversal of initial motor 64 rotation direction can be accomplished using the controller 58.

Both types of the linkage assemblies shown in FIGS. 1 and 2 are well known in the art. Further, it should be understood that the linkage assembly 56 for use in the present invention may be any arrangement capable of linking the door closer 80 to the door 42 in such a manner that the door closer assembly 54 affects movement of the door 42. Thus, numerous alternative forms of the linkage assembly 56 may be employed. Conventionally, the door closer assembly 54 typically includes an internal return spring mechanism such that, upon rotation of the door closer shaft 82 during door opening, the spring mechanism will be compressed for storing energy. As a result, the door closer 80 will apply on the linkage assembly 56 a moment force which is sufficient for moving the door 42 in a closing direction. The stored energy of the spring mechanism is thus released as the door closer shaft 82 rotates for closing the door 42. The closing characteristics of the door 42 can be controlled by a combination of the loading of the return spring mechanism and the controlled passage of fluid through fluid passages between variable volume compartments in the door closer housing, as is known in the art.

Figure 3:
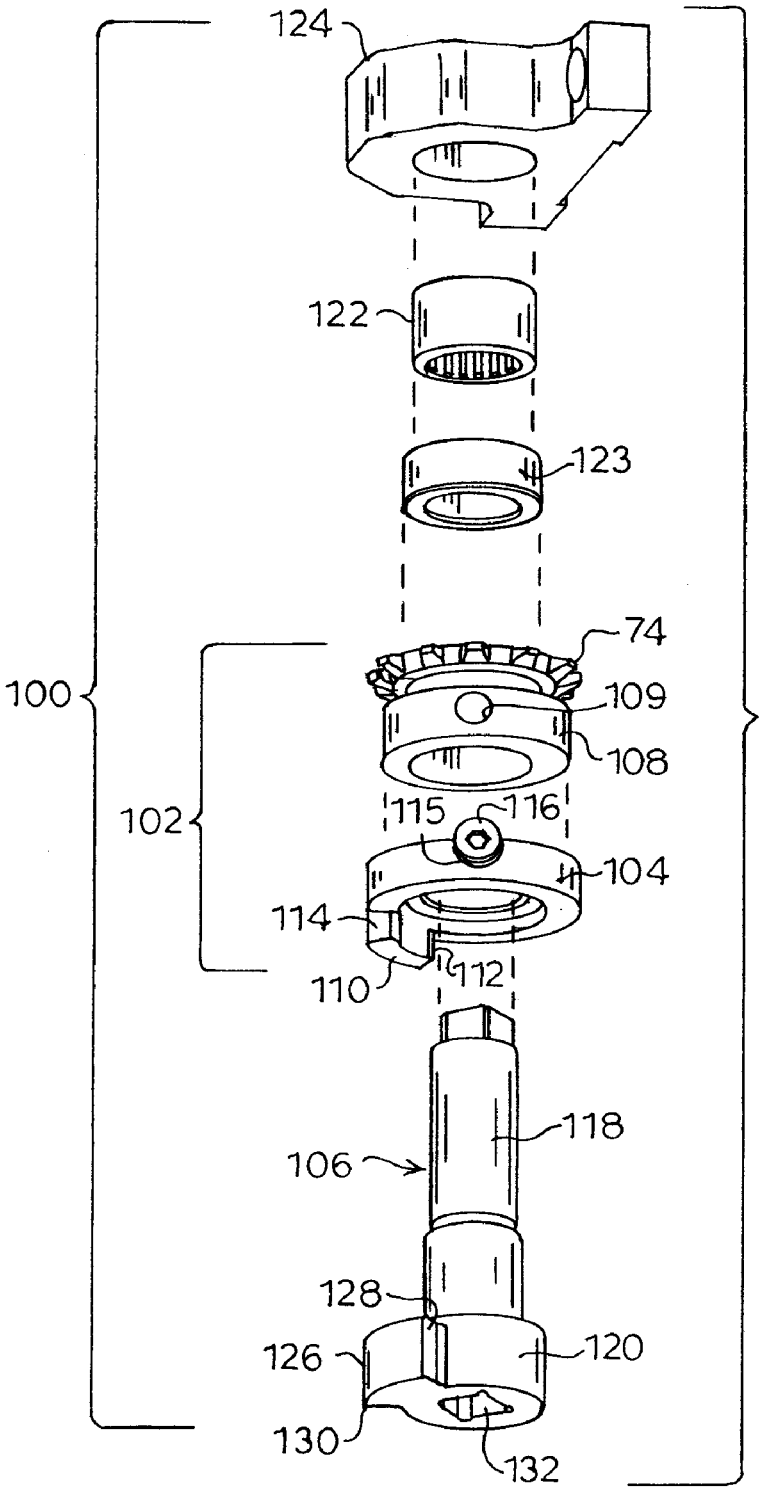
FIG. 3 is an exploded view of a drive mechanism according to the present invention for use with the door operator shown in FIG. 1.
Figure 4:
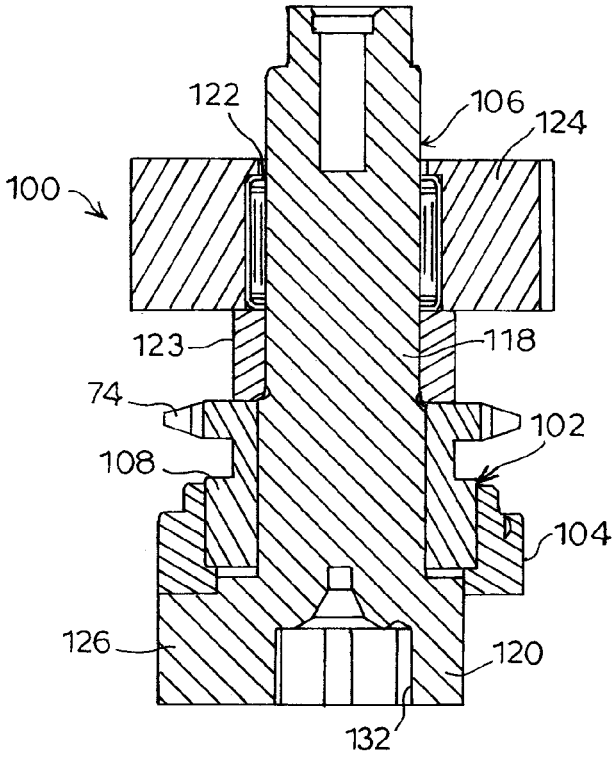
FIG. 4 is a longitudinal cross-section view of the assembled drive mechanism shown in FIG. 3.

According to the present invention, a drive mechanism is provided between the drive train and the door closer assembly 54 and is generally designated at 100. When the door operator 40 is used for powered opening of the door 42, the drive mechanism 100 transmits the rotation of the drive train of the motor assembly 52 to the door closer assembly 54 for opening the door 42. Referring to FIGS. 3 and 4, the drive mechanism 100 comprises a drive assembly 102, including the driven gear 74 and a cam driver 104, and a pinion extension 106. As described above, a sprocket functions as the driven gear 74 of the drive train and is operably connected with the drive gear 70 on the motor drive shaft 68 through the roller chain 72 (FIG. 1). The drive assembly 102 is thus operably connected for rotation with the motor drive shaft 68.

The driven gear 74 is provided with a hollow circular body portion 108 coaxial with and depending from the sprocket. The body portion 108 has two radial threaded bores 109. The cam driver 104 is ring-shaped and includes a partial wall 110 axially extending from a surface of the cam driver 104. The partial wall extension 110 has a first driving surface 112 and a second driving surface 114. A free space is defined between the driving surfaces 112, 114. The cam driver 104 is sized for receiving the body portion 108 of the driven gear 74. The cam driver 104 includes two radial openings 115 which align with the threaded bores 109 in the body portion 108 of the driven gear 74. Threaded fasteners 116 secure the cam driver 104 to the body portion 108 of the driven gear 74 through the openings 115 such that the driven gear 74 and cam driver 104 function integrally as a unit.

The pinion extension 106 has a cylindrical shaft portion 118 and a circular head portion 120 at one end which has a larger diameter than the shaft portion 118. The head portion 120 includes a radially projecting arch-shaped drive lug 126 having a first engaging surface 128 and a second engaging surface 130.

Referring to FIG. 4, the pinion extension 106 is rotatably received within the drive assembly 102. The drive assembly 102 and pinion extension 106 are arranged such that the end of the drive assembly 102 rotates against the inner surface of the head portion 120 of the pinion extension 106. In this configuration, the drive lug 126 on the pinion extension 106 is in the same plane as the partial wall extension 110 of the cam driver 104. The shaft portion 118 of the pinion extension 106 extends through the drive assembly 102 and is received in a needle bearing 122 in a pillow block 124 which is secured to the back plate 50 (FIG. 1). As best seen in FIG. 2, a non-circular opening 132 is provided in the head 120 of the pinion extension 106 for non-rotatably receiving the shaft 82 of the door closer 80. A spacer 123 is provided between the drive assembly 102 and the pillow block 124 to keep the pinion extension 106 on the shaft 82, and for providing room for operative engagement of the roller chain 72 and driven gear 74.

Figure 6:
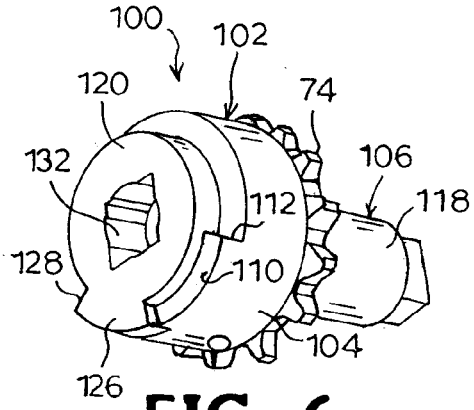
FIGS. 5 and 6 are perspective views of the drive mechanism shown in FIG. 3 in extreme positions of relative engagement.
Figure 5:
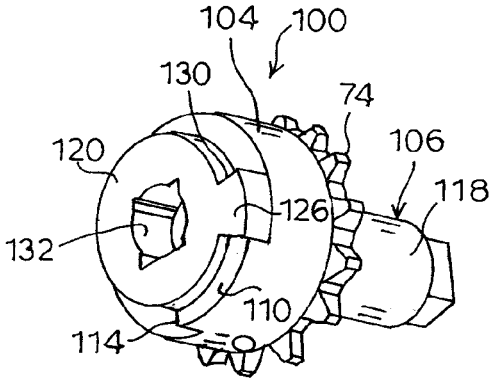

The two extreme positions of the relatively rotatable cam driver 104 and pinion extension 106 are shown in FIGS. 5 and 6. In the first position, shown in FIG. 5, the first driving surface 112 of the cam driver 104 is adjacent the first engaging surface 128 of the lug 126. In the second position, shown in FIG. 6, the second driving surface 114 of the cam driver 104 is adjacent the second engagement surface 130 of the lug 126. The pinion extension 106 is free to rotate between the first and second positions in the free space defined by the driving surfaces 112, 114 of the wall extension 110 without the lug 126 engaging the wall extension 110. It should be apparent that a large range of rotational movement of the pinion extension 106 is possible with this arrangement and that the range is only limited by the length of the arc of the wall extension 110 and lug 126. Because the pinion extension 106 is secured to the door 42 through the door closer assembly 54, this arrangement also allows associated movement of the door 42 during opening and closing without engagement of the drive train of the motor assembly 52. It should also be apparent that when the drive assembly 102 is rotated by the motor 64, clockwise as seen in FIG. 5 and counter-clockwise as seen in FIG. 6, one of the driving surfaces 112, 114 will engage the adjacent engaging surface 128, 130 of the lug 126 thereby imparting rotation to the pinion extension 106 and the door 42 for moving the door 42 in the opening direction. Reversing the motor 64 for rotation in the opposite direction will cause the driving surface 112, 114 to rotate away from the adjacent engaging surface 128, 130 of the lug 126 and, as will be described below, the door 42 will begin to move in the closing direction due to the energy in the spring mechanism of the door closer 80. The pinion extension 106 will rotate with the door closer shaft 82 during movement of the door 42 in the closing direction.

Figure 7:
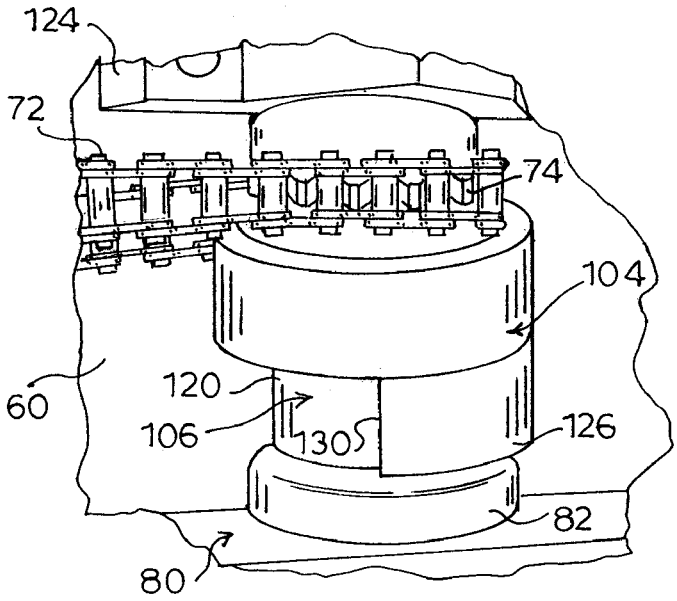
FIG. 7 is a close-up view of the drive mechanism and door operator shown in FIG. 1 when the door is in a closed position.
Figure 8:
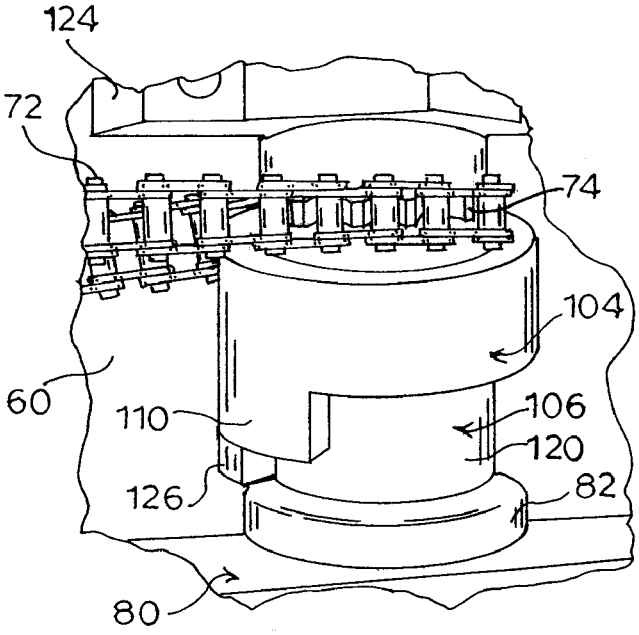
FIG. 8 is a close-up view of the drive mechanism and door operator shown in FIG. 7 with the door in an open position.
Figure 9:
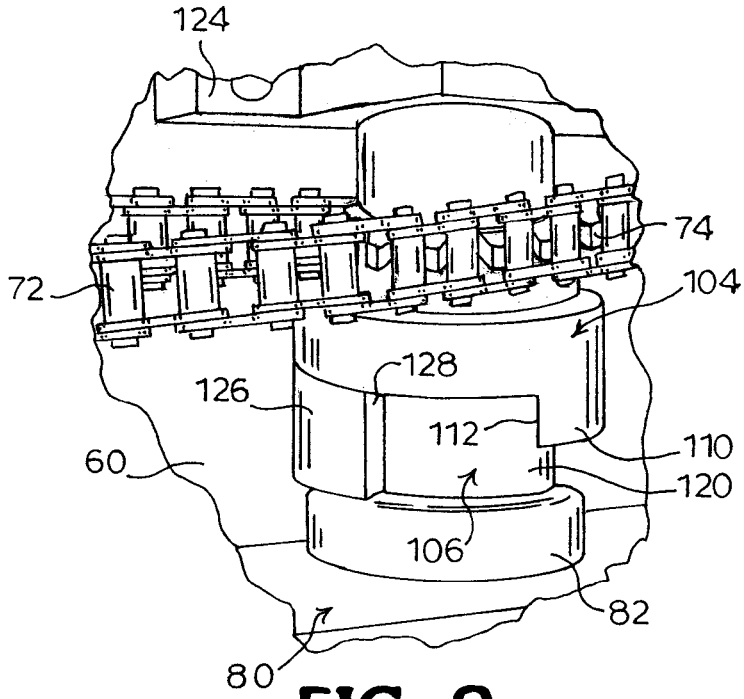
FIG. 9 is a close-up view of the drive mechanism and door operator shown in FIG. 7 with the door moving in the closing direction.
Figure 10:
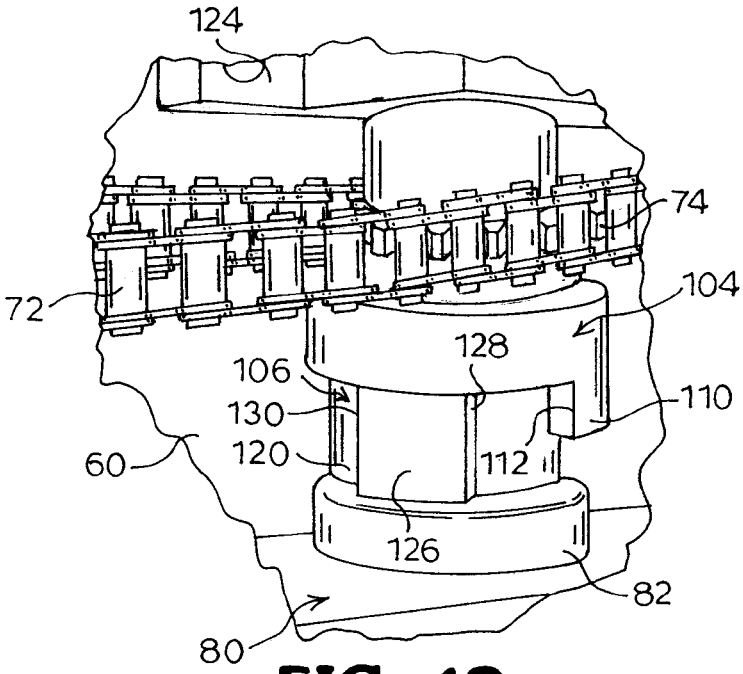
FIG. 10 is a close-up view of the drive mechanism and door operator shown in FIG. 7 with the door continuing to move in the closing direction.

FIGS. 7-10 are close up views of the drive mechanism 100 and door operator 40 as shown in FIG. 1 during an opening and closing cycle. In FIG. 7, the door 42 is in a closed position. In the closed position, the first driving surface 112 of the cam driver 104 is adjacent the first engaging surface 128 of the lug 126. When the motor 64 is activated, the cam driver 104 is rotated by the motor 64 as a part of the drive assembly 102. This, in turn, will rotate the pinion extension 106 thereby opening the door 42. The drive assembly 102 is rotated under power to a predetermined position as shown in FIG. 9, usually where the door 42 is fully open. As will be described more fully below, once the door 42 has reached the fully open position, the motor 64 reverses for rotating the drive assembly 102 in the opposite direction and causing the driving surface 112 of the cam driver 104 to move away from the engaging surface 128 of the lug 126 (FIG. 9). The door 42 will then be moved in a closing direction by the force of the door closer 80. The pinion extension 106 will rotate in the same direction as, but normally never contact, the cam driver 104. As shown in FIG. 10, the cam driver 104 will reach its original position before the pinion extension 106, which will reach its original position (FIG. 7) when the door 42 is in the closed position.

The controller 58 is in electrical communication with the motor 64, which is adapted to receive signals from the controller 58. The controller 58 includes a suitable microprocessor for controlling the operation of the motor 64 and functions to generate appropriate signals to the motor 64 for rotating the drive train in one direction or the other. The controller 58 may also function to maintain the door 42 in an open position for a selected period of time for enabling a person to go through the door opening. The controller 58 may also be adjusted to generate signals which control the speed of the motor 64 for controlling the speed of opening the door 42. It is understood that although the controller 58 is shown mounted to the back plate 50, the controller 58 could also be housed internally within the wall 48, a ceiling, or remotely, such as in a mechanical room, for example. A suitable controller 58 for use in the door operator 40 of the present invention is available from KB Electronics, Inc. of Coral Springs, Fla.

The controller 58 is part of an overall control system which may include an input device 136 (FIG. 1) in electrical communication with the controller 58 for allowing a user to selectively control the delivery of electrical energy to the motor 64. The input device 136 is operable to generate a door movement signal to the controller which, in turn, is responsive to receiving the door movement signal to control operation of the motor 64 so as to selectively cause the motor 64 to rotate the motor drive shaft 68 and thereby effect powered opening of the door 42. The input device 136 may be of any known or desired type. For example, the input device 136 may consist of a manual push pad wall switch for being mounted on the wall 48, or a post, adjacent to the door 42. This arrangement is such that a user, such as, for example, a handicapped person wanting to pass through the door opening need only to press the push pad 136 for activating the door operator 40 to open the door 42. Various other input devices are also suitable for use according to the present invention, including any type of switch, sensors and actuators, such as pressure pads as in a switch type floor mat and other mechanical switching devices, infrared motion sensors, radio frequency sensors, photoelectric cells, ultrasonic presence sensor switches, and the like. As a result of some of these input devices, an automatically operable door is caused to open by mere proximity of a person to the door. Such proximity may cause the door to operate by virtue of the interruption of a light beam, distortion of an electrical field or by actual physical closing of the switch by contact with the person or in response to the weight of the person approaching the door. Consequently, the particular manner for generating a door movement signal to the controller 58 for energizing the motor does not form part of the present invention and can be accomplished through any of numerous well known means.

Figure 11:
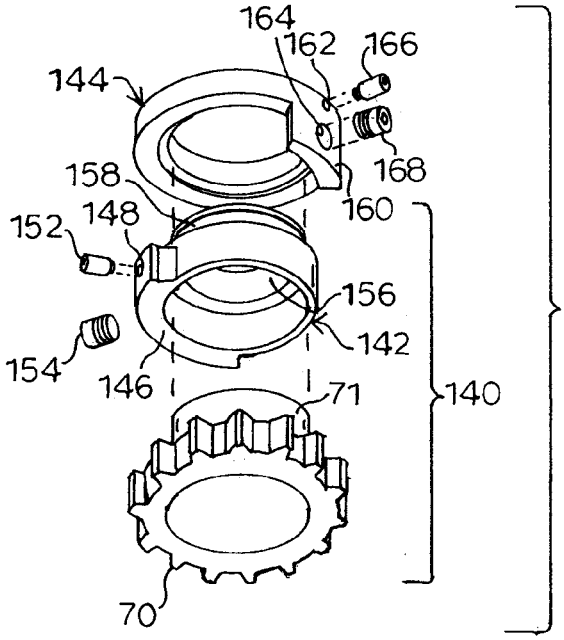
FIG. 11 is an exploded view of a door position assembly according to the present invention for use with the door operator shown in FIG. 1.
Figure 12:
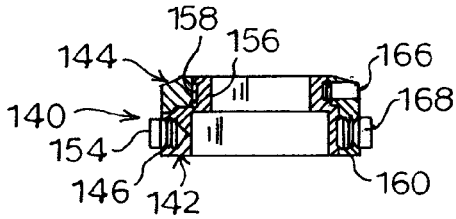
FIG. 12 is a longitudinal cross-section view of the assembled door position assembly shown in FIG. 11.

In keeping with the present invention, a door position assembly is provided and is generally designated at 140. Referring to FIGS. 11 and 12, the door position assembly 140 comprises a door closed position ring 142 and a door open position ring 144. The closed position ring 142 includes a radial lug 146. The radial lug 146 has two circumferentially spaced radial openings 148, 150 (only one of which is visible in FIG. 11) for receiving a set screw 152 and a magnet 154, respectively. The closed position ring 142 is provided with a smaller diameter coaxial hollow body portion 156. The body portion 156 has an external annular groove 158.

The open position ring 144 includes a wall extension 160. The wall extension 160 has two vertically spaced openings 162, 164 for receiving a set screw 166 and a magnet 168, respectively. The open position ring 144 is sized for rotatably receiving the body portion 156 of the closed position ring 142 such that the wall extension 160 is in the same plane as the lug 146 on the closed position ring 142 (FIG. 11). This configuration also positions the magnets 154, 168 in the same plane and aligns the set screw opening 162 in the open position ring 144 with the annular groove 158 in the closed position ring 142. The set screw 166 in the open position ring 144, when partially tightened, secures the rings 142, 144 against relative axial movement, but will allow relative rotation until the set screw 166 is fully tightened.

Figure 13:
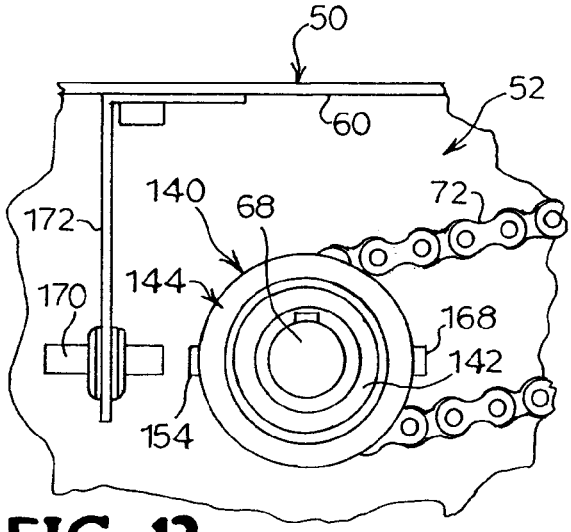
FIG. 13 is a close-up top plan view of the door position assembly in position on the motor drive shaft of the door operator shown in FIG. 1.

The door position assembly 140 is mounted on a hollow circular body portion 71 of the drive gear 70, coaxial with and depending from the sprocket. The assembly is then mounted 70 on the motor drive shaft 68 (FIGS. 1 and 2). As best seen in FIG. 13, a sensor 170, preferably an electronic magnetic detection device, such as a reed switch or a Hall effect sensor, is secured to a bracket 172 in close proximity to the door position assembly 140. The sensor 170 is responsive to the angular position of the door position assembly 140 for transmitting to the controller 58 an input signal which is indicative of the position of the door 42. Specifically, the sensor 170 becomes conductive as one of the magnets 154, 168 approach the sensor 170 during rotation of the door position rings 142, 144. It is understood that the sensor 170 could be an optical sensor or a microswitch without departing from the present invention.

The relatively rotatable door position rings 142, 144 allow for selectively setting the door positions at which an input signal is sent to the controller 58 indicating the door position. Initially, when the door 42 is closed, the closed position ring 142 is adjusted by manually rotating the closed position ring 142 relative to the motor drive shaft 68 so that the magnet 154 on the closed position ring 142 is aligned with the sensor 170 for signaling the controller 58 that the door 42 is in the closed position. The closed position ring 140 is then secured to the body portion 71 of the drive gear 70 by tightening the set screw 152. The open position ring 144 is then adjusted by manually rotating the open position ring 144 relative to the closed position ring 142 so that the magnet 168 on the open position ring 144 is aligned with the sensor 170 when the door 42 is at a desired open position when the door 42 is opened under power. The open position ring 144 is secured to the closed position ring 142 with the set screw 166. It is understood that the door position assembly 140 can accommodate a range of door 42 opening angles, even beyond the 180°, due to the range of relative rotation of the position rings 142, 144 as limited only by the length of the arc of the lug 146 and the wall extension 160. The selected limit of rotation would depend upon the desired characteristics of the door 42 installation.

The door operator 40 includes an electrical circuit for providing electrical communication between a source of electrical energy and the various electrical components. Apertures are formed in the back plate 50 for passage of electrically conductive wiring (not shown), including wiring from the controller 58 to the source of electrical energy, from the input device 136 to the controller 58, and between the controller 58 and the motor 64. The electrical circuit associated with the door operator system 40 may contain a customary on/off switch to permit cutting of power in the event that it is desired to operate the door 42 in manual mode only.

To install the door operator 40, the back plate 50 is mounted to the upper edge of the door frame 44. The linkage assembly 56 is mounted to the door 42 for connecting the door closer assembly 54 and the door 42. The user adjusts the door position assembly 140 and motor 64 speed. The input device 136 is connected to the wall 48 adjacent the door frame 44. The user may make any other systems connections which may be desired.

Figure 14A:
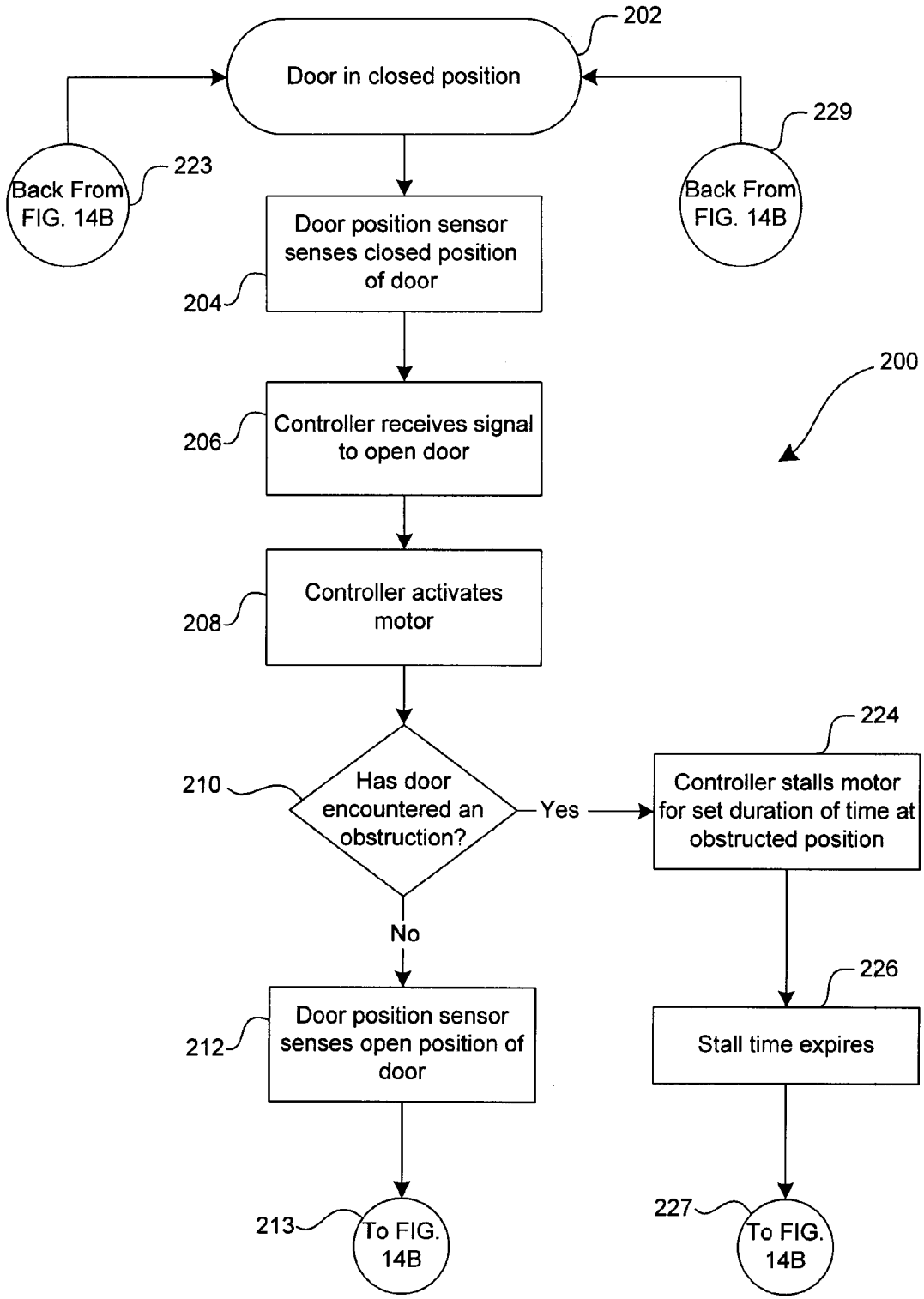
FIGS. 14A and 14B are a flow diagram of an automated door operating sequence according to the present invention.
Figure 14B:
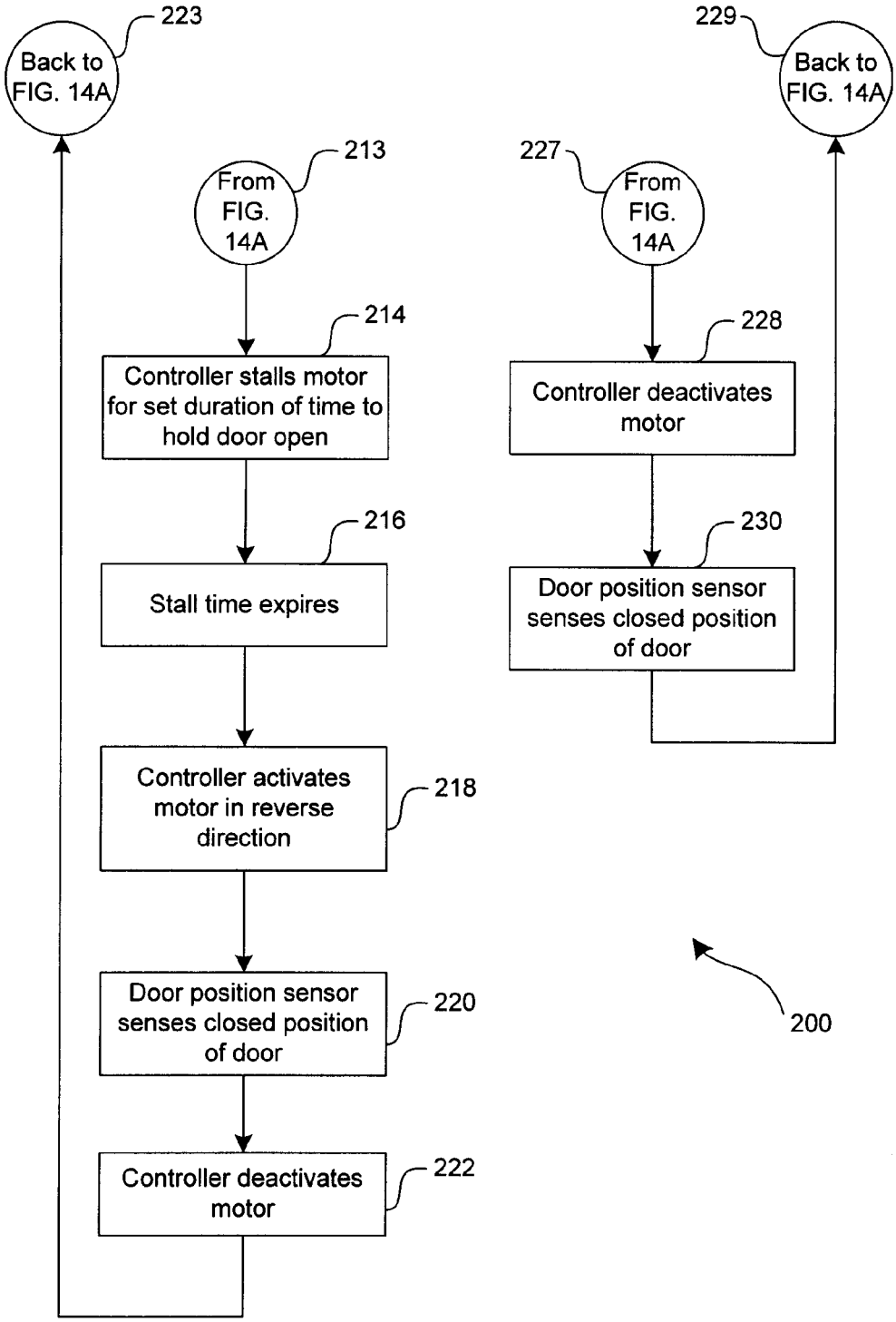

In keeping with the present invention, the controller 58 functions to provide a programmed operating sequence which directs the door operator 40 through opening and closing, and may include safety features to insure that operation is satisfactory and safe. An operating sequence according to the present invention is shown in FIGS. 14A and 14B and generally designated at 200. The sequence 200 begins on FIG. 14A with a door in closed position step 202 and continues with a step 204 in which the door position sensor 170 senses the closed position ring magnet 154 signaling the controller 58 that the door 42 is in the closed position. In a next step 206 of the operating sequence, the controller 58 receives a signal to open the door 42, which is typically generated by a user actuating the input device 136. This is immediately followed by a step in which the controller 58 activates the motor 64 which begins to move the door 42 in an opening direction.

After the controller 58 activates motor step 208, the operating sequence 200 progresses to a decision step 210. The decision step 210 senses and determines if the door 42 has encountered an obstruction. If NO, the motor 64 continues to move the door 42 in an opening direction, and the program sequence 200 then progresses to a step 212 at which the door position sensor 170 senses the door open position ring magnet 168. The operating sequence 200 continues through a transfer circle 213 to FIG. 1$B to a step 214. The step 214 causes the controller 58 to stall the motor 64 for a predetermined period to hold the door 42 open, which is usually of sufficient duration for allowing a user to move through the opening. The stall time expires in a step 216. After the stall time expires step 216, the controller 58, in a step 218, causes the motor 64 to reverse direction which, as described above, rotates the partial wall extension 110 of the cam driver 104 away from the lug 126 of the pinion extension 106 as the door 42 is moved in the closing direction by the door closer assembly 54. The program sequence 200 continues with a step 220 in which the door position sensor 170 senses the closed position ring magnet 154 indicating the door 42 is in the closed position. This is immediately followed by a step 222 in which the controller 58 deactivates the motor 64. After the program step 222, the operating sequence 200 continues through a transfer circle 223 to FIG. 14A and returns to the program step 202 with the door in the closed position.

If the decision step 210 is YES, the door 42 has encountered an obstruction during powered opening, the program sequence continues to a step 224 which causes the controller 58 to stall the motor 64 for a predetermined period to hold the door 42 at the obstructed position. The stall time expires in a step 226. After the stall time expires in the step 226, the operating sequence 200 continues through a transfer circle 227 to FIG. 14B to a program step 228. In the step 228, the controller 58 deactivates the motor 64. This allows the door closer assembly 54 to back drive the motor 64 and move the door 42 in the closing direction. The controller 58 could also cause the motor 64 to reverse direction (not shown) for rotating the partial wall extension 110 of the cam driver 104 away from the lug 126 of the pinion extension 106, as described above. In a step 230, the door position sensor 170 senses the closed position ring magnet 154 indicating the door 42 is in the closed position. After the program step 230, the operating sequence 200 continues through a transfer circle 229 to FIG. 13A and returns to the program step 202 with the door in the closed position. The obstruction sensing feature of the operating sequence 200 allows the door operator 40 to tolerate user or other interference at any point during powered opening of the door 42. If a user attempts to arrest the motion of an automatically opening door 42, power is removed from the motor 64 so that the door 42 can be overcome by the user. This sequence is preferably initiated by detecting a motor current increase surpassing a predetermined value for a predetermined duration. In this embodiment, the controller 58 is provided with an appropriate feedback signal and is programmed to monitor the current going to the motor 64 to detect an obstruction impeding the movement of the door 42 as indicated by a spike in the motor current. It is understood that other operating parameters could be monitored and we do not intend the limit the invention to the motor current. For example, the obstruction sensing means could also be a fuse or circuit breaker which will interrupt power to the motor and the clutch when the motor draws an excessive amount of power.

When a user desires to open the door 42 and does not actuate the input device 136, the user simply opens the door 42 by manually pushing or pulling on the door 42. According to the present invention, opening of the door 42 by the user is restricted only by the spring force of the door closer 80. Door closing is accomplished and controlled by the door closer assembly 54. Because the lug 126 of the pinion extension 106 is free to rotate within the free space defined by the wall extension 110 on the cam driver 104, the door 42 moves between the open and closed positions without engagement of the drive assembly 102. Thus, there is no movement of the power components of the door operator 40 and wear on the motor 64 and drive train is minimized. Accordingly, the door operator 40 of the present invention enables the door 42 to be selectively operated under power or as a normal free swinging door with a door closer.

The door operator 40 of the present invention can be used with a left-hand door or a right-hand door. Changing from one application to the other requires an 180° rotation of the door operator 40. FIGS. 1 and 2 show the door operator 40 installed on a left-hand door 42. To install the door operator 40 on a right-hand door 42, the door operator 40 must be flipped 180° and attached to the upper edge of the door frame 44. In this arrangement, the non-circular end (FIG. 3) of the pinion extension 106 opposite the head 120 is secured for rotation with the end of the first connecting arm link 86, 94 of the linkage assembly 56. The drive mechanism 100 can alternatively be non-handed, in which case the cam driver 104 could be partially bored for rotatably receiving the pinion extension 106. It is understood that either the cam driver 104 or pinion extension 106 would have to be rotatably secured to the back plate 50. Similarly, the pinion extension 106 could be bored to receive the cam driver 104, which could carry the lug 126 and the pinion extension could present the partial wall extension 110. The cam driver 104 and pinion extension 106 could also be solid members. In this arrangement, the cam driver 104 and pinion extension 106 could each carry the lug 126, wall extension 110, or other protrusion for effecting cooperative movement between the members.

The door operator 40 can also be used in a door assembly having a single door or multiple doors. For example, two door operators 40 could be provided adjacent a door frame to open and close opposing doors. The door operator 40 of the present invention may also be provided as part of a retrofitting kit for mounting to a residential or commercial door assembly to thereby convert the door assembly to an selectively automatically operated door.

According to the present invention, a door operator system is provided which meets the accessibility requirements of the disabled while preserving the functionality necessary for meeting compliance requirements of the standard door closer. Typical compliance requirements, such as those established in the ANSI Guidelines, include minimum efficiency standards for door closers. For the powered mode of operation, the door operator 40 according to the present invention meets ANSI guidelines for low energy power operated doors (ANSI/BHMA A156.19-2002). In the manual mode of operation, the door operator 40 according to the present invention functions as a typical manual door closer meeting the requirements of a Grade 1 door closer as delineated in the ANSI Guidelines (ANSI/BHMA A156.4-2000).

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, some of the novel features of the present invention could be used with any type of powered door operator. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. A drive mechanism for a door operator for selectively automatically operating a door positioned within a door frame and hinged along one edge to the door frame for movement between a closed position and an open position, the door operator including a bi-directional motor assembly connected to a source of electrical energy, and a door closer assembly including a rotating output member operably connected to the door and means for providing a force on the output member when the door is in an open position for moving the door in a closing direction, the drive mechanism comprising:

a drive member including a protrusion formed on the surface of the drive member, one edge of the protrusion forming a first driving surface and the other edge of the protrusion forming a second driving surface, the driving surfaces defining a free space of at least about 90° between the driving surfaces, the drive member adapted to be operably connected to the motor assembly for rotating the drive member about an axis through an arc in a first direction from a first angular orientation corresponding to the closed position of the door to a second angular orientation corresponding to the open position of the door and about the axis through an arc in an opposite direction from the second angular orientation to the first angular orientation, wherein rotation of the drive member from the first angular orientation to the second angular orientation corresponds to movement of the door from the closed position to the open position; and a driven member including a protrusion formed on the surface of the driven member, one side of the protrusion forming a first driven surface and the other side of the protrusion forming a second driven surface, the driven member disposed for relative rotation adjacent to the drive member such that the respective protrusions rotate in substantially the same plane and the driven member protrusion moves in the free space defined by the driving surfaces of the drive member protrusion, the driven member adapted to be operably connected for rotation with the output member of the door closer assembly about an axis through an arc between a first angular orientation corresponding to the closed position of the door and a second angular orientation corresponding to the open position of the door and about the axis through an arc in an opposite direction from the second angular orientation to the first angular orientation, wherein rotation of the driven member from the second angular orientation to the first angular orientation corresponds to movement of the door from the open position to the closed position, wherein when the drive member and the driven member are in their respective first angular orientations, one of the driving surfaces of the protrusion of the drive member is adjacent one of the driven surfaces of the protrusion of the driven member such that rotation of the drive member from the first angular orientation of the drive member to the second angular orientation of the drive member in a direction toward the adjacent driven surface causes rotation of the driven member for powered opening of the door from the closed position to the open position, and the protrusion on the driven member moves in the free space between the first angular orientation of the driven member and the second angular orientation of the driven member without engaging the protrusion surfaces when the door is opened manually from the closed position and allowed to close.

2. A drive mechanism as recited in claim 1, wherein the protrusions extend from the surfaces of the drive member and the driven member in a direction substantially parallel to the axis of rotation of the drive member and the driven member.

3. A drive mechanism as recited in claim 1, wherein the drive member has an opening for rotatably receiving at least a portion of the driven member.

4. A drive mechanism as recited in claim 3, wherein the protrusion on the drive member extends from the surface of the drive member in a direction substantially parallel to the axis of rotation of the drive member, and the protrusion on the driven member extends radially outwardly from the surface of the driven member.

5. A drive mechanism as recited in claim 3, wherein the opening in the drive member extends through the drive member, and the ends of the drive member are adapted to be operably connected for rotation with the output member of the door closer assembly.

6. A drive mechanism as recited in claim 5, wherein the protrusion onthe drive member extends radially outwardly from one end of the driven member.

7. A drive mechanism as recited in claim 1, wherein the driven member has an opening for rotatably receiving at least a portion of the driven member.

8. A drive mechanism as recited in claim 7, wherein the protrusion on the driven member extends from the surface of the driven member in a direction substantially parallel to the axis of rotation of the driven member, and the protrusion on the drive member extends radially outwardly from the surface of the drive member.

9. An apparatus for use with a source of electrical energy for selectively automatically operating a door positioned within a door frame and hinged along one edge to the door frame for movement between a closed position and an open position, the door operating apparatus comprising:

a bi-directional motor assembly adapted to be connected to the source of electrical energy;

an automatic door closer assembly including a rotatable output shaft adapted to be operably connected to the door and means for providing a force on the output shaft when the door is in an open position for moving the door in a closing direction;

a drive member including a protrusion formed on the surface of the drive member, one edge of the protrusion forming a first driving surface and the other edge of the protrusion forming a second driving surface, the driving surfaces defining a free space of at least about 90 between the driving surfaces, the drive member operably connected to the motor assembly for rotating the drive member about an axis through an arc in a first direction from a first angular orientation corresponding to the closed position of the door to a second angular orientation corresponding to the open position of the door and about the axis through an arc in an opposite direction from the second angular orientation to the first angular orientation, wherein rotation of the drive member from the first angular orientation to the second angular orientation corresponds to movement of the door from the closed position to the open position; and a driven member including a protrusion formed on the surface of the driven member, one side of the protrusion forming a first driven surface and the other side of the protrusion forming a second driven surface, the driven member disposed for relative rotation adjacent to the drive member such that the respective protrusions rotate in substantially the same plane and the driven member protrusion moves in the free space defined by the driving surfaces of the drive member protrusion, the driven member adapted to be connected for rotation with the output shaft of the door closer assembly about an axis through an arc between a first angular orientation corresponding to the closed position of the door and a second angular orientation corresponding to the open position of the door and about the axis through an arc in an opposite direction from the second angular orientation to the first angular orientation, wherein rotation of the driven member from the second angular orientation to the first angular orientation corresponds to movement of the door from an open position to the closed position, wherein when the drive member and the driven member are in their respective first angular orientations, one of the driving surfaces of the protrusion of the drive member is adjacent one of the driven surfaces of the protrusion of the driven member such that rotation of the drive member from the first angular orientation of the drive member to the second angular orientation of the drive member in a direction toward the adjacent driven surface causes rotation of the driven member for powered opening of the door from the closed position to the open position, and the protrusion on the driven member moves in the free space between the first angular orientation of the driven member and the second angular orientation of the driven member without engaging the protrusion surfaces when the door is opened manually from the closed position and allowed to close.

10. A door operating apparatus as recited in claim 9, wherein the protrusions extend from the surfaces of the drive member and the driven member in a direction substantially parallel to the axis of rotation of the drive member and the driven member.

11. A door operating apparatus as recited in claim 9, wherein the drive member has an opening for rotatably receiving at least a portion of the driven member.

12. A door operating apparatus as recited in claim 11, wherein the protrusion on the drive member extends from the surface of the drive member in a direction substantially parallel to the axis of rotation of the drive member, and the protrusion on the driven member extends radially outwardly from the surface of the driven member.

13. A door operating apparatus as recited in claim 11, wherein the opening in the drive member extends through the drive member, and the ends of the drive member are adapted to be operably connected for rotation with the output member of the door closer assembly.

14. A door operating apparatus as recited in claim 13, wherein the protrusion on the drive member extends radially outwardly from one end of the driven member.

15. A door operating apparatus as recited in claim 9, wherein the driven member has an opening for rotatably receiving at least a portion of the driven member.

16. A door operating apparatus as recited in claim 15, wherein the protrusion on the driven member extends from the surface of the driven member in a direction substantially parallel to the axis of rotation of the driven member, and the protrusion on the drive member extends radially outwardly from the surface of the drive member.

17. A door operating apparatus as recited in claim 9, further comprising means for actuating the motor, the actuating means including an input device in electrical communication with the motor and activated by a user for selectively directing power to the motor for initiating powered movement of the door from the closed position to an open position.

18. A door operating apparatus as recited in claim 17, wherein the actuating means comprises a controller connected between the input device and the motor and responsive to input signals form the input device for selectively controlling the operation of the motor for moving the drive member between the first and second angular orientations of the drive member.

19. A door operating apparatus as recited in claim 18, further comprising a first annular sensor and a second annular sensor ring, each of the sensor rings carrying a switch actuating element, the sensor rings disposed for relative rotation on a shaft that rotates with door movement such that the switch actuating elements rotate in substantially the same plane, wherein sensor rings and shaft may be non-rotatably secured together at selected angular positions based on predetermined door positions; and a switch responsive to the switch actuating elements for transmitting a signal to the controller, the input signal being indicative of the selected angular position of the rings, wherein the controller is responsive to the signal for terminating power to the motor, stalling the motor, or reversing the motor direction.

20. A door operating apparatus as recited in claim 19, wherein the shaft rotating with door movement comprises rotatable output shaft on the motor.

21. A door operating apparatus as recited in claim 18, further comprising means for detecting excessive current drawn by the motor, the controller responsive to the excessive current detecting means for terminating power to the motor.

22. A door operating apparatus as recited in claim 18, wherein the controller is remote from the door.

23. In combination:

a door frame for mounting to a building wall;

a door pivotally connected to the door frame for movement between a closed position and an open position; and an electro-mechanical door operator mounted on one of the door or the building wall, the door operator comprising a bi-directional motor assembly adapted to be connected to a source of electrical energy, an automatic door closer assembly adapted to be operably connected to the door, the door closer assembly including a rotatable output shaft and means for providing a force on the output shaft when the door is in an open position for moving the door in a closing direction, a drive member including a protrusion formed on the surface of the drive member, one edge of the protrusion forming a first driving surface and the other edge of the protrusion forming a second driving surface, the driving surfaces defining a free space of at least about 90° between the driving surfaces, the drive member operably connected to the motor assembly for rotating the drive member about an axis through an arc in a first direction from a first angular orientation corresponding to the closed position of the door to a second angular orientation corresponding to the open position of the door and about the axis through an arc in an opposite direction from the second angular orientation to the first angular orientation, wherein rotation of the drive member from the first angular orientation to the second angular orientation corresponds to movement of the door from the closed position to the open position, and a driven member including a protrusion formed on the surface of the driven member, one side of the protrusion forming a first driven surface and the other side of the protrusion forming a second driven surface, the driven member disposed for relative rotation adjacent to the drive member such that the respective protrusions rotate in substantially the same plane and the driven member protrusion moves in the free space defined by the driving surfaces of the drive member protrusion, the driven member adapted to be connected for rotation with the output shaft of the door closer assembly about an axis through an arc between a first angular orientation corresponding to the closed position of the door and a second angular orientation corresponding to the open position of the door and about the axis through an arc in an opposite direction from the second angular orientation to the first angular orientation, wherein rotation of the driven member from the second angular orientation to the first angular orientation corresponds to movement of the door from an open position to the closed position, wherein when the drive member and the driven member are in their respective first angular orientations, one of the driving surfaces of the protrusion of the drive member is adjacent to one of the driven surfaces of the protrusion of the driven member such that rotation of the drive member from the first angular orientation of the drive member to the second angular orientation in a direction toward the adjacent driven surface causes rotation of the driven member for powered opening of the door from the closed position to the open position, and the protrusion on the driven member moves in the free space between the first angular orientation of the driven member and the second angular orientation of the driven member without engaging the protrusion surfaces when the door is opened manually from the closed position and allowed to close.

* * * * *